US005251809A

United States Patent [19]

Drummond et al.

[11] Patent Number: 5,251,809

[45] Date of Patent: Oct. 12, 1993

[54] EASY-OPEN CONTAINER FOR REFRIGERATED DOUGH PRODUCTS AND THE LIKE

[75] Inventors: Michael T. Drummond; General Taylor, both of Florence; W. Gerald Gainey, Darlington, all of S.C.

[73] Assignee: Sonoco Products Company, Hartsville, S.C.

[21] Appl. No.: 936,603

[22] Filed: Aug. 27, 1992

Related U.S. Application Data

[63] Continuation of Ser. No. 746,056, Aug. 12, 1991.

[51] Int. Cl.[5] ..... B65D 85/00

[52] U.S. Cl. ..... 229/202; 229/4.5; 493/276; 493/299; 493/962; 426/128

[58] Field of Search ..... 229/201, 202, 4.5, 132; 493/279, 299, 288, 962; 426/128, 122, 112

[56] References Cited

U.S. PATENT DOCUMENTS

| | | | |
|---|---|---|---|
| 1,698,908 | 1/1929 | Cleveland . | |
| 2,225,026 | 12/1940 | Welsh | 493/299 X |
| 2,502,638 | 4/1950 | Becht | 493/288 X |
| 2,793,127 | 5/1957 | Geist et al. . | |
| 2,814,428 | 11/1957 | Magill . | |
| 2,891,714 | 6/1959 | Vallas . | |
| 2,901,162 | 8/1959 | Vallas . | |
| 2,904,240 | 9/1959 | Southwell et al. . | |
| 3,035,753 | 5/1962 | Erekson . | |
| 3,042,285 | 7/1962 | Smith . | |
| 3,081,213 | 3/1963 | Chinn | 493/299 X |
| 3,088,624 | 5/1963 | Kinghorn et al. . | |
| 3,182,891 | 5/1965 | Ecklund et al. . | |
| 3,215,328 | 11/1965 | White . | |
| 3,221,975 | 12/1965 | Zoeller et al. . | |
| 3,274,905 | 9/1966 | Demsey, Jr. et al. | 493/288 X |
| 3,304,185 | 2/1967 | Fortney | 229/202 X |
| 3,331,549 | 7/1967 | Beasley | 229/202 |
| 3,366,493 | 1/1968 | Stump . | |
| 3,397,834 | 8/1968 | Hanlon et al. | 229/202 X |
| 3,656,513 | 4/1972 | Evans et al. | 493/299 X |
| 3,951,890 | 4/1976 | Reilley et al. | 206/389 X |
| 3,960,624 | 6/1976 | Erlandson | 493/276 X |
| 3,972,468 | 8/1976 | Reid . | |
| 3,980,249 | 9/1976 | Cunningham et al. | 493/276 X |
| 3,981,433 | 9/1976 | Thornhill et al. | 229/202 |
| 3,982,686 | 9/1976 | Parlour et al. . | |
| 3,994,396 | 11/1976 | Reilley et al. | 206/389 |
| 4,093,073 | 6/1978 | Leezer | 229/202 |
| 4,158,425 | 6/1979 | Sansbury . | |
| 4,235,341 | 11/1980 | Martin et al. . | |
| 4,343,427 | 8/1982 | Sansbury | 493/299 X |
| 4,379,014 | 4/1983 | Rausing et al. . | |
| 4,526,290 | 7/1985 | Cerny . | |
| 4,717,374 | 1/1988 | Elias | 493/299 X |
| 4,770,338 | 9/1988 | Tatusch . | |
| 4,779,738 | 10/1988 | Akutsu et al. . | |
| 4,919,949 | 4/1990 | Miltz et al. . | |
| 4,948,450 | 8/1990 | Hurter et al. | 156/90 X |
| 5,076,440 | 12/1991 | Drummond | 229/202 |
| 5,084,284 | 1/1992 | McDilda et al. | 229/202 X |

*Primary Examiner*—Stephen P. Garbe
*Assistant Examiner*—Christopher McDonald
*Attorney, Agent, or Firm*—Bell, Seltzer, Park, Gibson

[57] ABSTRACT

The invention provides spirally wound easy-open containers which comprise a spirally wound body wall having overlapped edges and which have capabilities and benefits associated with conventional butt jointed containers. The overlapped edges of the body wall define an easy-open seam extending helically between the ends of the container. A temporary adhesive between the overlapped edges of the body wall releasably adheres the overlapped edges of the body wall together and allows for opening of the container along the helical, easy-open seam. The easy-open containers provided according to the invention can be readily manufactured with only slight modifications to the conventional manufacturing process. Nevertheless, the easy-open containers of the invention can provide for material savings in container label construction and can allow for vacuum packaging of food products such as dough.

32 Claims, 4 Drawing Sheets

EASY-OPEN CONTAINER FOR REFRIGERATED DOUGH PRODUCTS AND THE LIKE

This application is a continuation of application Ser. No. 07/746,056, filed Aug. 12, 1991.

FIELD OF THE INVENTION

The invention relates to an easy-open container for products such as biscuit and bread dough and the like. More specifically, the invention relates to an easy-open container comprising a spirally wound body wall and including an easy-open seam extending helically between the ends of the container.

BACKGROUND OF THE INVENTION

Composite containers for packaging products under pressure, particularly, refrigerated dough products, constitute a significant commercial consumer product. Typically, the containers are formed of a spirally wound paperboard or boardstock layer; an interior liner which is a laminate including kraft paper, foil and/or polymer layers; and an exterior label. The spirally wound boardstock layer includes an unglued butt joint extending helically from end to end of the can. The exterior label surrounds the boardstock and covers the butt joint thereby preventing the premature opening of the butt joint.

Commercially significant containers of this type are disclosed in U.S. Pat. No. 3,981,433 to Thornhill et al. which is directed to one step easy-open containers including an inner liner having a helical fold positioned opposite the unbonded helical butt joint. When the outer wrapper is removed, the dough and the liner expand outwardly together as the liner fold or pleat begins to unfold. The resultant pressure on the can body causes the butt joint to open. This in turn automatically allows the inner liner to expand further. The liner is automatically opened by the rapidly expanding dough to thereby allow access to the dough in the interior of the container.

The outer label surrounding the butt joint in containers of this type is an important structural component of the container because the outer label bridges the butt joint and maintains it in the closed position. Accordingly, the label must be strong in order to prevent premature opening of the container. Such structural requirements for the label prevent the use of more economical low strength sheet materials for construction of the label.

It is generally recognized that vacuum packaging with easy-open containers of the butt joint type can only be accomplished with difficulty, if at all. Because of the structural design of the composite container, the application of vacuum to the interior of the container often results in partial or complete inward collapsing of the container walls along the butt joint seam. This can result in an unacceptable appearance for the composite container or in unacceptable sealing of the product within the container.

The manufacture of butt jointed easy-open containers is accomplished by a process including the step of spirally winding boardstock about a mandrel. The winding operation must be carried out in a highly precise manner so that edges of the boardstock are in continuous contact, but not overlapped, along the entire length of the mandrel. Boardstock width must also be uniform or there will be gaps between adjacent edges of the boardstock wrapped around the mandrel.

Numerous modifications have been proposed for easy-open spirally wound composite containers. For example, an easy-open container having a spirally wound lap joint is proposed in U.S. Pat. No. 3,221,975 to Zoeller et al. The overlapping edge of the joint is permanently glued to the underlying ply. A plurality of discontinuous perforations are provided in the overlapping seam so that the overlapping seam, itself, forms a tear strip for opening of the container.

U.S. Pat. No. 4,235,341 to Martin et al. proposed a spirally wound container having a thin paper base stock wrapped with an inner ply of film adhering to the surface of the base stock to add strength to the composite container. The container was said to include a spiral seam which could be perforated if desired but which was said to be in most cases an overlapped glued seam which would burst when the outer ply was removed and the container was twisted open or banged against a hard edge. The inner ply surrounding the base stock was said to tear with the body ply along the spiral seam when the container was twisted or banged against a hard surface.

Numerous other proposals have been made for modifying and improving easy-open spirally wound containers particularly in view of the consumer preference for these containers and the convenience associated with them. Nevertheless, no substitute easy-open container for dough and similar products has been commercialized having the benefits and capabilities associated with spirally wound butt jointed easy-open containers while overcoming deficiencies associated therewith.

SUMMARY OF THE INVENTION

In accordance with this invention, new spirally wound easy-open containers are provided which have the capabilities and benefits associated with conventional butt jointed containers and which additionally provide capabilities and efficiencies beyond those of the conventional easy-open containers. For example, in various preferred embodiments, containers of the invention can be vacuumed packed and/or hermetically sealed without substantial damage to the container wall. Easy-open containers constructed according to the invention can in preferred embodiments be provided with thinner and/or more economical outer label constructions while exhibiting the same strength as conventional easy-open containers. The easy-open containers provided according to the invention can be constructed using conventionally available spiral winding manufacturing equipment and conventional boardstock, conventional liner materials, conventional closure members and the like.

In one embodiment, the invention provides easy-open containers including a spirally wound body wall having overlapped edges and defining a substantially cylindrical container. The overlapped edges of the body wall define an easy-open seam extending helically between the ends of the container. A temporary adhesive is provided between the overlapped edges of the body wall for releasably adhering the overlapped edges of the body wall together and to allow opening of the container wall along the easy-open seam. The overlapped edges of the spirally wound container body add strength to the container wall thereby preventing or minimizing collapse of the container wall during conventional vacuum packaging operations. Although preferably an outer label is provided around the body wall, the label can be made of weaker and more economical materials because the overlapped edges of the body wall assist in maintaining the easy-open seam closed, thereby decreasing the structural requirements for the outer label.

The temporary adhesive provided between the overlapped edges of the container body is advantageously an adhesive material having a high initial tack, i.e., adhesion, but which dries to a solid frangible layer. Preferably, the temporary adhesive is present between the overlapped edges of the container body as a substantially discrete layer; that is, the temporary adhesive does not penetrate substantially into the container body wall. Advantageously, the edges of the container body are compression skived prior to spiral winding so that the edges are more resistant to adhesive penetration and so that the outside surface of the container body is relatively smooth and continuous in both appearance and feel. Because the temporary adhesive has a high initial tack strength, an end closure member can be attached to the container end prior to drying of either the outer container label adhesive or the inner container liner adhesive thus allowing for manufacturing efficiencies equivalent to the conventional easy open container manufacturing process. However, since the temporary adhesive dries to a form a layer having little adhesive strength, an easy-open seam is provided helically from end to end of the container along the overlapped edges of the container body wall.

Advantageously, the easy-open container of the invention includes a flexible sheet liner bonded to the inner surface of the cylindrical body wall which comprises an expandable fold or pleat extending helically between the ends of the container. The fold is positioned adjacent or overlapping the easy-open seam of the body wall. The marginal areas adjacent both sides of the easy-open seam on the interior of the body wall are free of bonding to the liner to assist in release of the releasably adhered overlapped edges of the body wall which define the easy-open seam.

Easy-open containers provided according to the invention are not substantially different in appearance or in apparent operation from the familiar butt jointed easy-open containers. The easy-open containers provided according to the invention can be readily manufactured with only slight modification to the conventional manufacturing operation. Yet, the easy-open containers according to the invention can provide for material savings in container label construction and can allow for vacuum packaging of food products, including dough, snack products and the like. The manufacturing operation can be simplified in that slight variations in the amount of overlap along the easy-open seam can be readily accommodated.

BRIEF DESCRIPTION OF THE DRAWINGS

In the drawings which form a part of the original disclosure of the invention.

DETAILED DESCRIPTION OF THE PREFERRED EMBODIMENT

In the following detailed description various preferred embodiments of the invention are described. It will be understood, however that the invention is not to be limited to its preferred embodiments. But to the contrary, the invention includes various alternatives, modifications and equivalents within its spirit and scope as will be apparent to the skilled artisan.

Figure 1:
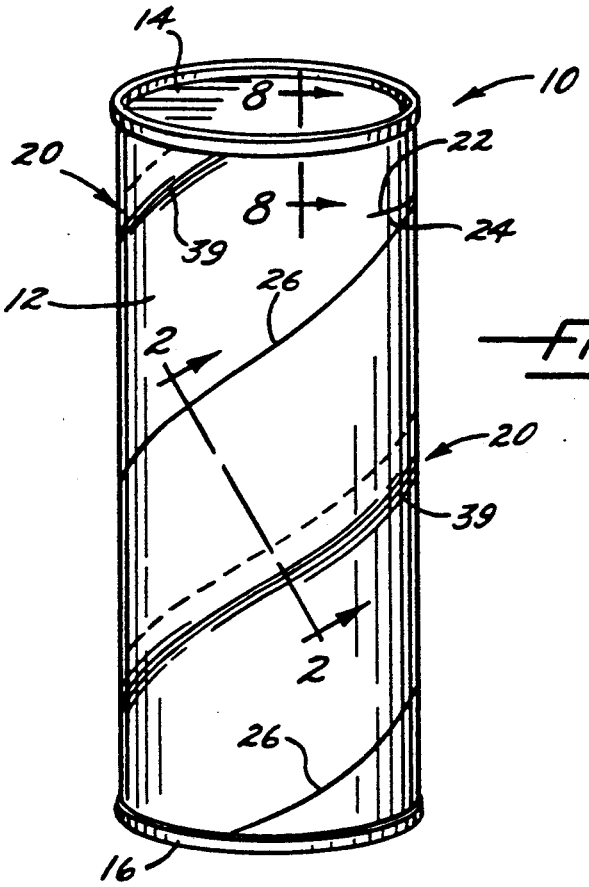
FIG. 1 is a perspective view of an easy-open container provided according to a preferred embodiment of the invention.

FIG. 1 illustrates in perspective, a preferred easy open container 10 provided according to the invention. As seen from the outside, the container 10 is of substantially cylindrical form and includes a continuous spirally wound outer label 12. A top end closure 14 and a bottom end closure 16 are provided on the opposed ends of the container. An easy open overlapped seam 20 is disposed beneath outer label 12. A short tab cut 22 is provided in the outer label and extends for a short distance in the circumferential direction around the top of the can. This allows the consumer to remove the outer label 12 by grasping the unglued tab 24 of the outer label and pulling, which in turn, initiates a tear circumferentially in the top of the outer label. Outer label 12 is thereupon unwound along outer label seam 26, thereby exposing easy open seam 20.

Figure 2:
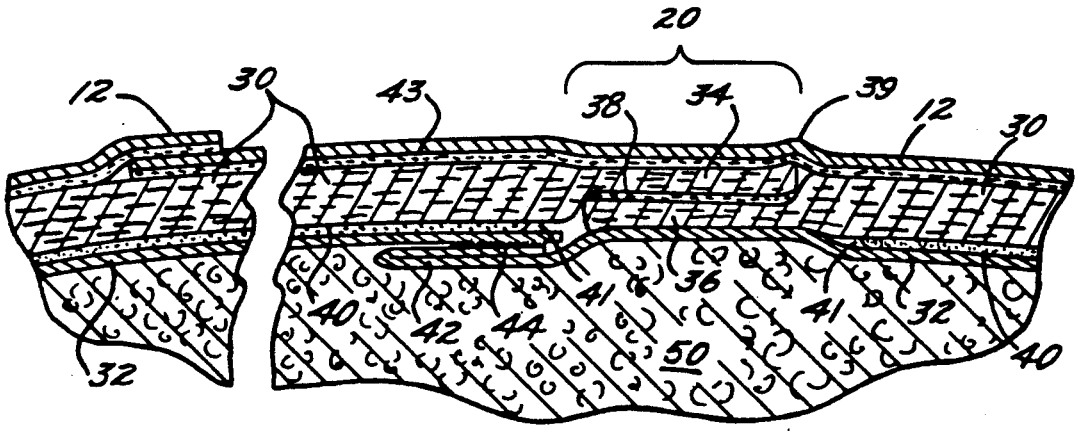
FIG. 2 is a greatly enlarged fragmentary sectional view taken along line 2—2 of FIG. 1 and illustrates the construction of the easy-open seam of the body wall of the container together with the preferred construction of the container liner and also illustrates the outer label.

The construction of seam 20 is best seen in FIG. 2 which is a greatly enlarged fragmentary cross-sectional view taken along line 2—2 of FIG. 1. With reference to FIG. 2, it will be seen that the composite can body includes outer label 12, a body wall layer 30 and an inner liner layer 32. The body wall 30 is advantageous composed of conventional spiral winding paperboard or boardstock having a thickness of between about 0.10 and about 0.35 inch, preferably between about 0.15 and 0.30 inches, for example, 0.021 inches. Boardstock conventionally used in the manufacture of spiral wound containers is commercially available from various manufacturers including Sonoco Products Corporation; Republic Paperboard Corporation and Middletown Board Corporation. In order to function advantageously as the spirally wound body wall, the boardstock typically is composed of kraft or recycled paper and can typically range from, e.g. 50 to 100 lbs/ream. In some instances the boardstock can include a weak exterior layer, e.g., a 0.003 inch exterior news layer.

It will be seen that joint 20 is formed from longitudinally overlapping and transversely compressed body wall edges 34 and 36. An adhesive layer 38 is provided between overlapping body wall edges 34 and 36. As discussed in greater detail below, the adhesive provided in adhesive layer 38, is advantageously a temporary adhesive material which provides temporary bonding of overlapped edges 34 and 36 during the manufacturing operation, but which dries to a layer of low adhesive strength so that an easy open seam 20 is provided by the overlapping edges of the body stock. Each of the overlapping edges 34 and 36 of the body wall 30 are advantageously compressed to a thickness of less than the thickness of the main body wall 30, as illustrated in FIG. 2. Compression of the overlapping edges is advantageous in that the body wall thickness is not substantially increased at the overlapped joint, thus improving appearance of the container. In addition, compression of the overlapped edges decreases penetration of the temporary adhesive into the overlapped edges which, as discussed in greater detail below, improves the release properties of adhesive layer 38.

As best seen in FIG. 2, there is a visibly apparent ridge 39 at the edge of easy open seam 20. The provision of an exterior visibly apparent ridge can be advantageous in providing to the consumer an identification of the location of the easy open seam. The visibly apparent ridge is an optional feature of the invention which can be either eliminated or emphasized by modifying the type and/or degree of compression of the overlapping edges 34 and 36.

Inner liner 32 is advantageously a barrier type, flexible sheet material such as a polymer/foil; a kraft/foil/polymer; a polymer/polymer; or a kraft/foil laminate. The barrier sheet inner liner prevents the escape of liquids, oils, and preferably, gases into or out of the container wall. A permanent adhesive layer 40 is provided between the inner liner 32 and the container body 30. Preferably, there is a small marginal area 41 on each side of the overlapping seam 20, which is free of bonding in order to assist in fracturing or release of adhesive layer 38 upon opening of the container. An expandable fold or pleat 42 is provided adjacent or overlapping seam 20. The expandable fold 42 is heat sealed to an overlapping edge of the liner via a heat seal 44 which as illustrated in FIG. 2 extends along only a portion of the under side of fold 42. As discussed in greater detail later, fold 42 is provided to assist in allowing the food product, such as dough 50, contained within the container, to expand, thereby forcing open overlapped joint 20.

Outer label 12 is advantageously adhered to the outer surface of container body 30 via a adhesive layer 43 which is preferably, also a temporary adhesive formed from dextrin or the like. Outer layer 12 can be made of any suitable material, such as kraft paper, a polymer/foil laminate, a kraft paper/foil laminate, or the like.

Figure 3:
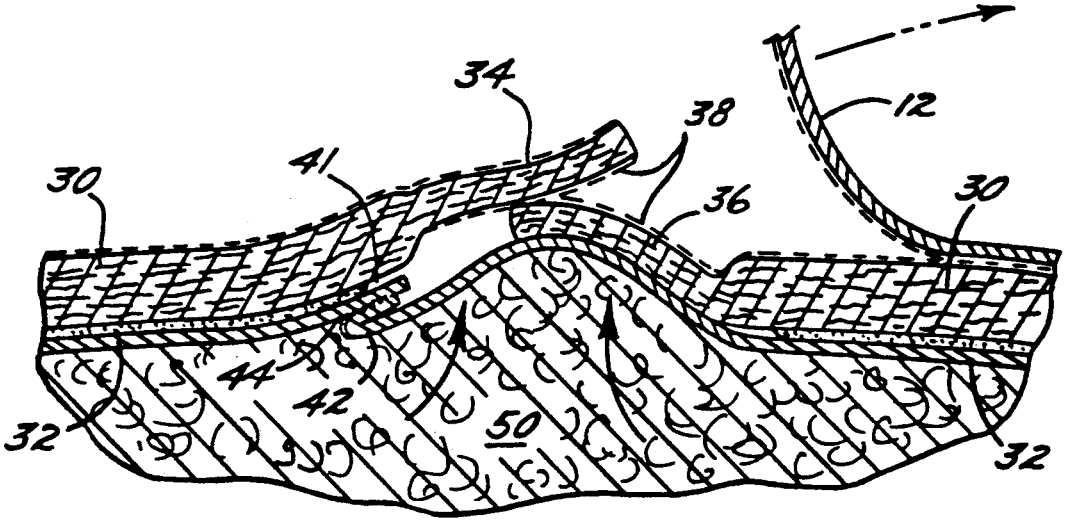
FIGS. 3 and 4 are cross sectional views illustrating the manner in which the container automatically opens along the easy-open seam following removal of the outer label.
Figure 4:
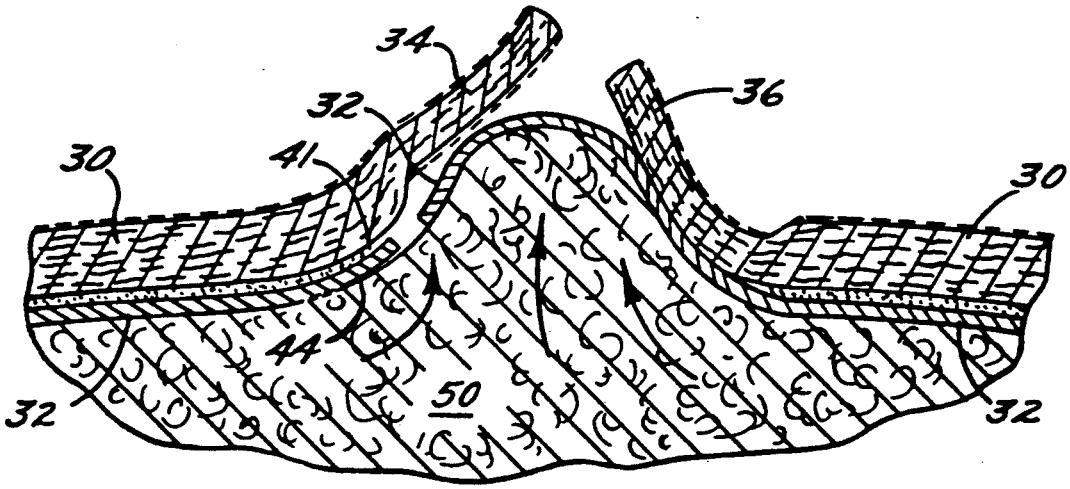

FIGS. 3 and 4 illustrate the opening of the overlapped easy opening seam 20, which is provided in easy open containers of the invention. With reference to FIG. 3, the outer label 12 is peeled by the consumer by grasping the tab 24 defined by the seam 26 and the partial tab cut 24, (FIG. 1). As the label 12 is peeled away from the container body 30, the dough or other material 50, which is maintained under pressure of, for example 15–40 psi, exerts outward pressure on the container body wall. The expandable fold 42 begins to unfold, at the unsealed portion, first, thereby allowing dough 50 to expand, As dough 50 exerts outward pressure on the underlapping edge 36 of the container body, upward pressure is transferred to overlapping edge 34 of the container body. This in turn causes adhesive layer 38 to break, for example, by fracturing.

As shown in FIG. 4, the dough 50 continues to expand until liner 32 peels along heat seal 44 thereby providing for opening of the container along easy open seam 20. While not wishing to be bound by theory, it is believed that the provision of an unbonded area 41 between the liner 32 and container body wall 30, as shown in FIGS. 2 and 3, assists in opening of seam 20 because the lower or underlapped edge 36 of the container body joint is allowed to slip with respect to liner 32 as it expands outwardly. In addition, it is believed that provision of the unbonded margin on each side of easy open seam 20 ensures that there is no permanent adhesive which can incidentally find its way into the lower portion of the overlapped joint during the manufacturing process.

Temporary adhesive materials which can be employed in this invention can include numerous adhesives known to the skilled artisan. The term "temporary adhesive" is used herein to mean a material which provides a high-tack, i.e, adhesion, when wet, but which dries to a layer having little or no adhesive strength. Advantageously the temporary adhesive is present as a substantially discrete layer between the overlapping edges of the container body wall; that is, desirably the adhesive is prevented from penetration into the container body by, for example, a high viscosity adhesive, a release coating on the container body, or compression of the container body edge. The temporary adhesive layer can be provided by employing a high initial tack adhesive which dries to a readily frangible or fracturable crystalline form or by employing an adhesive layer which, upon drying, readily peels away from one or both of the overlapping edges 34, 36 of easy-open seam 20.

It is important that the adhesive material used to form temporary adhesive layer 38 have a high initial tack or adhesion so that the overlapped joint 30 is held together during, and immediately following, manufacture of the container primarily by the adhesive layer 38. If the initial adhesion of the adhesive material used to form layer 38 is too low, it is difficult or impossible to apply an end closure member to the container body immediately following manufacture of the container body because downward pressure on the container body, which typically accompanies the application of the end closure, can cause the overlapped edges to slide past each other resulting in longitudinal collapse of the container body. On the other hand, if the adhesive layer 38 dries to a layer having a high adhesive strength, then the container will not readily open. Thus, the dry adhesive strength of layer 38 will determine the ease or difficulty of opening of the container following removal of the label 12. For example, with an adhesive material having an extremely low dry adhesive strength, the container will be self-opening following removal of the outer label 12. On the other hand, if the adhesive layer has a somewhat higher dry adhesive strength it may be necessary for the consumer to press gently along overlapped seam 20 in order to initiate fracturing or release of adhesive layer 38. This may be desirable in some instances so that the consumer is not surprised by self-opening of the container immediately following removal of outer layer 12. Preferably the adhesive can have an initial tack, or adhesive strength when wet of from about 0.05 to 1.5 lbs/in, more preferably from about 0.1 to 0.4 lbs/in. As indicated previously, the degree of boardstock compression and/or the boardstock composition can also influence adhesive or peel strength.

Advantageously, the adhesive layer 38 is made up an adhesive material which dries to a solid frangible layer. Frangible adhesives are known to those skilled in the art. A dextrin based adhesive which has been modified to have a high initial tack has been employed successfully in the invention. This dextrin based adhesive is commercially available from National Starch and Chemical Corporation, Grand Prairie, Tex. as "71-5626B". This is a high solids (about 64%), high viscosity (about 21,000 cps) acid modified (about 2.5 pH) dextrine adhesive. Other frangible adhesives which can be successfully used in the invention can comprise heavily filled, resinous, aqueous emulsion type adhesives such as, for example, polyvinyl acetate dispersed in water together with a tackifying alcohol and an inert filler such as clay, silicon dioxide, calcium carbonate, talc or the like. The inert filler can ensure that a weak discrete layer of adhesive remains between the overlapping edges of the container body, and thereby provide for the fracture or breaking of the adhesive. In the alternative, a release coating, such as microcrystalline wax, silicone, or the like can be provided on the inner surface of either or both of, the overlapping edges 36 or 34 of the container body wall so that the adhesive layer is readily released upon drying, from the overlapping edges of the container body.

Compression skiving is believed to enhance the release of adhesive layer 38 from the overlapped edges of the container body because the boardstock is compressed and densified by the compression skiving operation. This, in turn, is believed to prevent penetration of the adhesive resin into the boardstock, thereby allowing the adhesive layer to readily peel away from the boardstock at the overlap seam. Compression skiving is a known operation in which the edge of paperboard is compressed between a pressure roll and a backup roll or between two pressure rolls. Compression skiving is believed to be beneficial with as little as 10 percent compression, i.e. the paperboard is compressed to about 90 percent of original thickness. Advantageously the edge of the body wall boardstock is compression skived to about 80 percent or less, preferably to between about 50 percent and about 75% of the original boardstock thickness.

Figure 5:
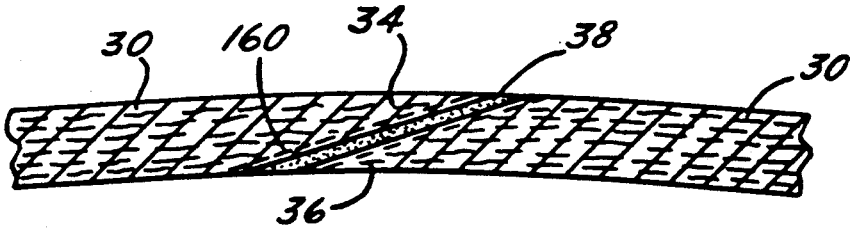
FIG. 5 is a cross-sectional view illustrating an alternate construction of an overlapped joint in a container according to the invention.

FIG. 5 illustrates another embodiment of the invention wherein the overlapping edges 34 and 36 of the container body wall 30 are beveled. Although beveling can be accomplished employing compression rolls, i.e., by compression skiving, it is also possible to bevel using a grinding or decaling process. Where a grinding or decaling process is used, the ground edge of boardstock 30 will typically be rough and porous. In such instances, it is considered highly advantageous to precoat the rough edge of the boardstock with an adhesive resistant or release material 160, prior to application of the adhesive material which forms temporary adhesive layer 38.

It will be recognized that the overlapping edges of the container body wall, which are joined by a temporary adhesive layer in accordance with this invention, can be provided in constructions and shapes other than those specifically illustrated in the drawings. For example, the container body wall edges can be overlapped without the compression skiving illustrated in FIG. 2, 3 and 4 or without the beveling shown in FIG. 5, particularly where the outer appearance of the container body is not considered important. Thus, the container body edges can be pretreated to apply a temporary adhesive layer and thereafter overlapped without compression or beveling, in which case an exterior ridge will extend helically around the exterior of the container body.

Figures 6, 7:
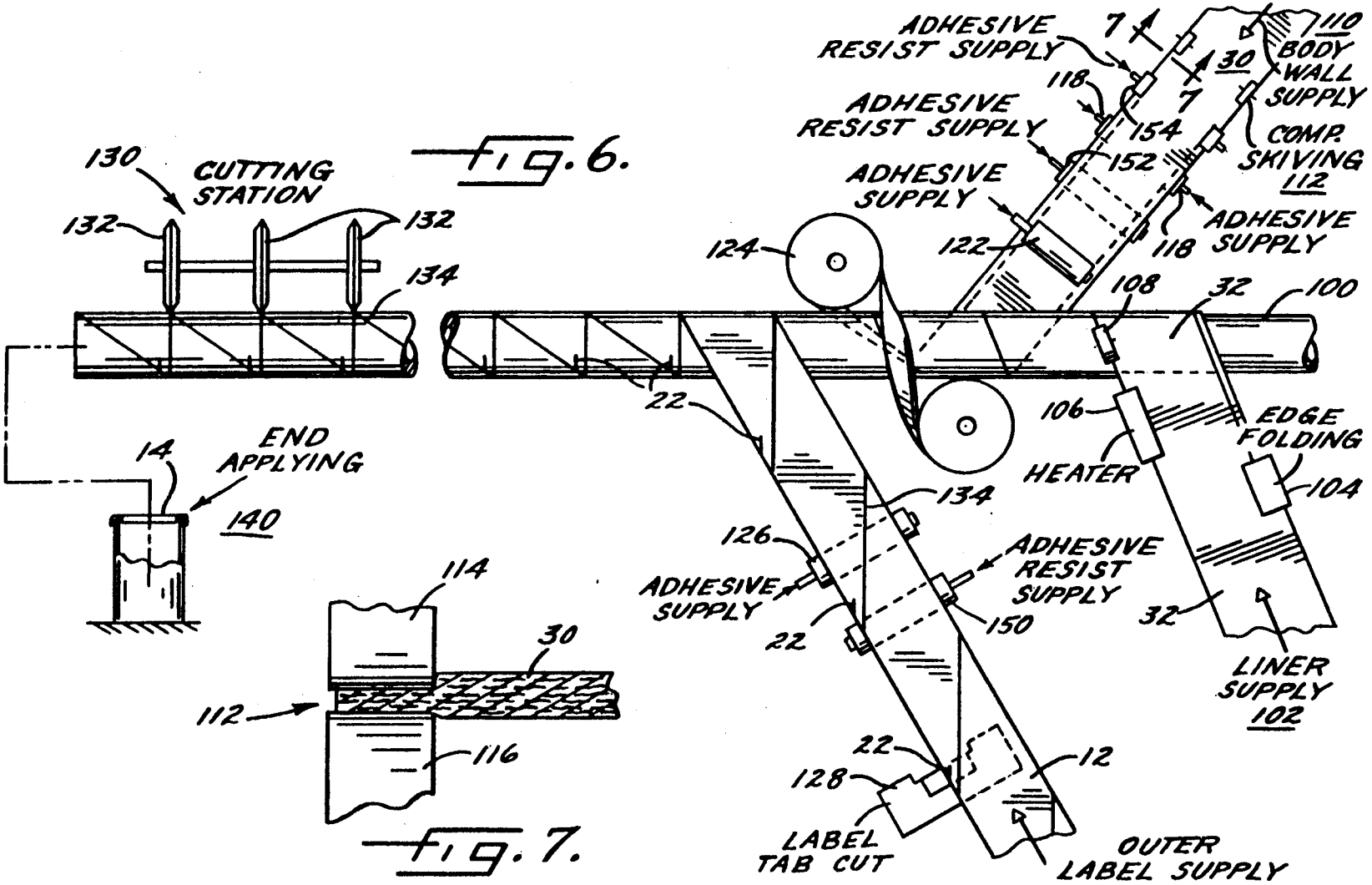
FIG. 6 diagrammatically illustrates a preferred method and apparatus for producing the container of FIG. 1.
FIG. 7 is a detailed view taken along line 6—6 of FIG. 5 and illustrates a compression skiving step conducted in a preferred embodiment of the invention.

The manufacture of containers having an overlapping body wall seam can be accomplished without substantial modification to the conventional container manufacturing process as illustrated in FIGS. 6 and 7. Referring now to FIG. 6, it will be seen that inner liner barrier sheet material 32 is initially spirally wound upon a stationary mandrel 100. As the liner 32 is supplied from supply 102 to mandrel 100, it passes across a folding means, such as a folding tongue 104. A portion of the other edge of liner 32 is heated by means of a heater 106. A pressure roller 108 applies pressure to the heated edge of the liner thereby bonding the liner to itself at the leading edge of fold 42 as shown in FIG. 2.

The container body wall is supplied from source 110 and boardstock is passed to mandrel 100. As the boardstock 30 is passed to the mandrel the edges on each side are treated in a compression skiving apparatus 112 (best seen in FIG. 6) which compresses the edge in by calendaring, employing a compression roller 114 and a back up roller 116. It will be apparent that on one side of boardstock 30 the compression roller operates on the top of the boardstock while on the other side or edge of the boardstock the compression roller 114 will operate on the bottom surface of the boardstock so that the depressions in the boardstock are located at each edge on opposite sides thereof. Alternatively, each of rolls 114 and 116 can be compression rolls with the result that the boardstock 30 will be evenly compressed on both top and bottom.

A frangible adhesive is applied to each compressed edge via adhesive applicators 118. It will be apparent that the temporary adhesive is applied to the same side of the edge of the paperboard as was compressed by the pressure roller; thus, on one edge temporary adhesive as applied to the top of the edge and is applied on the bottom side of the other edge. An adhesive applying roller 122 then supplies a permanent adhesive to the inside surface of the boardstock for bonding to the outside of liner 32. It will be seen that roller 122 is depicted as being of narrower width than the width of the boardstock 30 in order to ensure that no permanent adhesive is applied to the outer edges of the boardstock. The body wall boardstock is wound onto the mandrel, on top of the continuous inner liner layer so that the leading edge of the boardstock overlaps the trailing edge thereof and so that the compression skived edges are matched. The body wall inner liner layer laminate is then longitudinally displaced to the left on the mandrel 100 by means of a conventional belt conveying means 124.

The outer label layer 12 is fed longitudinally in edge overlapping relation to the mandrel 100 and is coated on its lower surface with a layer of liquid adhesive by roller applicator 126. Prior to application of adhesive, a stationary cutting member 128 provides a series of parallel tab cuts 22 in label 12 as disclosed in U.S. Pat. No. 4,091,718 to Thornhill, which is hereby incorporated herein by reference.

The pre-tab cut label layer 12 is then wound spirally in edge-overlapping adhesive bonded relation upon the outer surface of the body wall layer 30 whereupon the resulting laminate is conveyed by the belt conveyor 124 towards a cutting station 130 including a plurality of rotatably mounted knives 132 that circumferentially cut the tubular laminate into cylindrical sections or "can bodies" along circumferential cuts defined by dividing lines 134 which may be printed or unprinted. Alternatively, the laminate could be divided into desired longer lengths (for example an eight can body length), and be removed from the mandrel 100 for severing into sections at another cutting station as desired. Although cutting station 130 is shown mounted on the winder bed, the cutting operation can also be, and preferably is, accomplished by a secondary machine.

The severed can bodies are transported to an end applying station or "seamer" 140 where closure members are applied to one end of the container bodies.

Figure 7A:
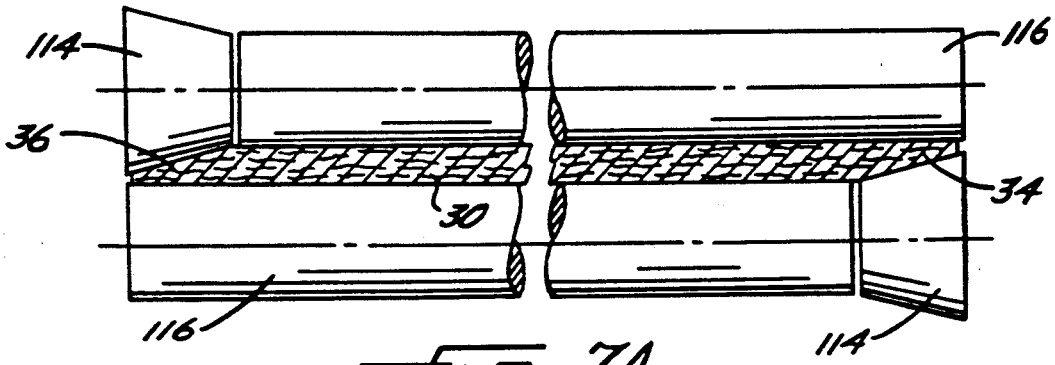
FIGS. 7A and 7B illustrate alternative compression skiving operations which can be employed to provide other preferred easy open containers according to the invention.
Figure 7B:
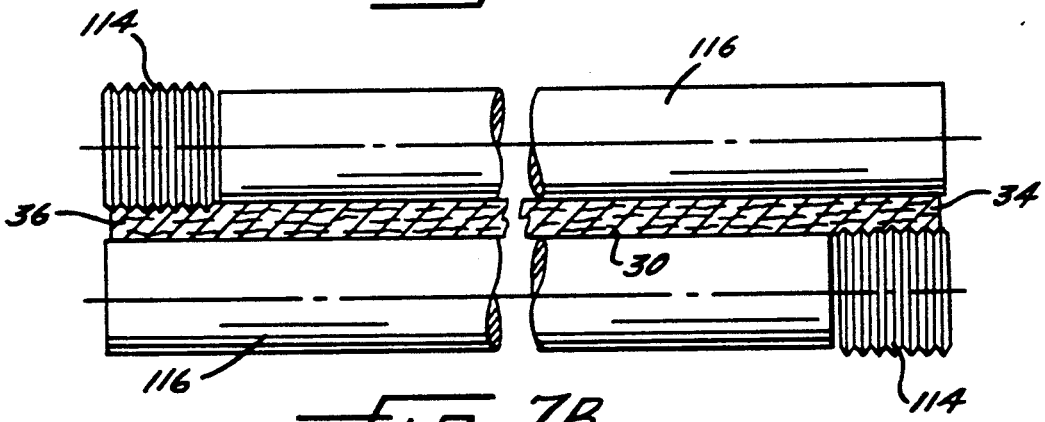

FIGS. 7A and 7B illustrate alternative edge skiving operations that can be employed in the invention. In FIG. 7A, compression skived, beveled edges 34 and 36 of boardstock 30, are formed using flared compression rolls 114 operating against soft backup rolls 116. In FIG. 7B, corrugated compression skived edges are provided using corrugated compression rolls 114 operating against backup rolls 116.

Figure 8:
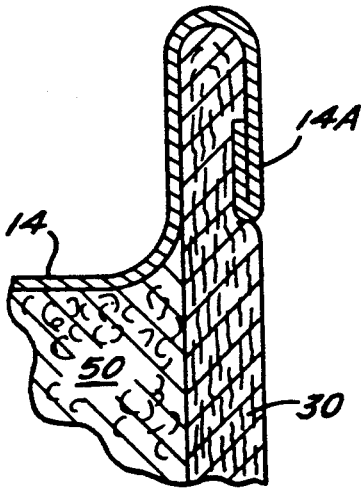
FIGS. 8, 8A and 8B are detailed views taken along line 7—7 of FIG. 5 and illustrate preferred end closure constructions for containers of the invention.
Figure 8A:
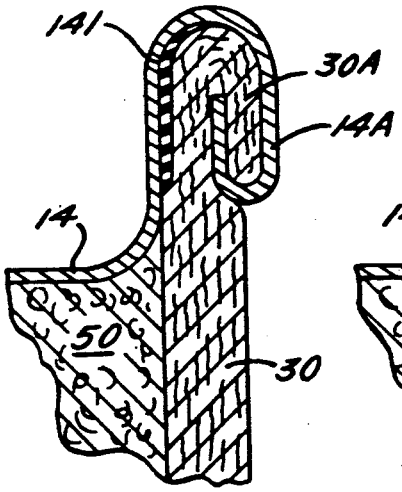
Figure 8B:
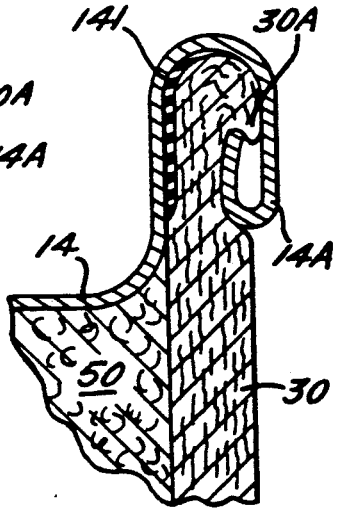

FIGS. 8, 8A and 8B illustrate three different end seam configurations for closure member constructions including the conventional crimped seam shown in FIG. 8, in which the peripheral edge 14A, only, of closure member 14 is folded or crimped to provide better gripping of the container body wall 30. In FIG. 8A, there is shown a "double lock" or "rolled on" seam construction in which a portion, 30A of the upper end of the body wall 30 is flared prior to the seaming operation and folded into the peripheral crimp or seam 14A in the closure member. A conventional compounding material 141 such as water-based or solvent-based neoprene rubber is applied to the interior of the closure member or to the can body interior peripheral end so that the sealing compound will be positioned between the inner liner (not shown) of the can body and the inner surface of the closure member 14 to form a seal after seaming. The double lock construction of FIG. 8A, although conventional in other types of paperboard can bodies, is not normally used in an easy-open, butted seam, paperboard cans because the flanging process is extremely difficult to apply to these containers. As the can body is bent and stressed outwardly, the butt joint normally comes apart.

FIG. 8B illustrates a partial double lock end closure construction in which the flanged end 30A of can body 30 extends only partially into the rolled edge or crimp 14A. Since the end 30A is not completely trapped by crimp 14A the consumer will find this closure easier to remove than the double lock closure of FIG. 8A. Nevertheless, due in part to the flanging operation and in part to the sealing compound 141, these closures can provide an acceptable hermetic seal.

In some instances, it will be desirable to form the double lock closure member construction of FIG. 8A and/or the partial double lock closure construction of FIG. 8B without the use of the compounding material 141. In such instances, the resultant seal will be better than the seal of the closure construction of FIG. 8 but will not be fully hermetic. Still another closure construction is to employ the crimped seam construction of FIG. 8 but wherein the can body end 30A is rolled outwardly prior to application of the closure member.

Returning to FIG. 5, it may be desirable to apply to the mating surfaces of either the body layer 30 or the label layer 12, opposite the line of circumferential end tab cut 22, a layer either of an adhesive resistant material (such as lecithin, silicone or a microcrystalline wax) or a release adhesive (such as polyvinylchloride or polyvinylacetate formulation using clay and water, or various hot melts) whereby the label layer may be more readily torn from the fibrous body wall layer. Thus, prior to passage of the label layer 12 to the adhesive supply applicator 126, the label layer can pass through a preliminary station 150 at which an adhesive resistant material or release adhesive is coated on the undersurface of the label layer opposite the line of circumferential cut 134. Alternatively, the adhesive resistant material or the release adhesive could be applied to the underside of the body wall layer 30 by a similar rotary applicator 152. Where greater adhesion is desired, a primer can be applied to the body wall or label layers by applicators 150 or 152.

It can also be desirable to apply an adhesive resistant material such as lecithin, silicone or a microcrystalline wax, or a release adhesive, such as polyvinylchloride or polyvinylacetate formulations including a filler such as clay and water, to the edges of the body wall prior to overlapping thereof. In such instances, the adhesive resistant material or release can be applied subsequent to the edge skiving treatment and prior to application of the adhesive by means of an adhesive applicator 154 shown in FIG. 5.

In any of its various embodiments, the container of the invention can provide significant benefits and advantages including significantly decreased structural requirements for the outer label layer. This can allow for the use of an outer label layer which is thinner and/or weaker than outer labels used in conventional butt jointed easy open containers. While not wishing to be bound by theory, it is believed that easy open containers of the invention provide for lower structural requirements for the outer label layer for at least two reasons. Because the edges of the container body are overlapping, the stress exerted by a pressurized product inside of the container, e.g., dough, is spread over a greater area as compared to conventional butt jointed walls, in which the stress is concentrated at a single helical line extending around the container body. Similarly with a product packaged under vacuum, the outer pressure is less likely to cause collapse of the easy open seam. In addition, it is believed that the temporary adhesive layer between the overlapping edges of the container body continues to effect some degree of adhesion even after drying. Thus, the temporary adhesive layer assists in maintaining the container body closed until the adhesive layer is fractured or peeled away.

By careful choice of temporary adhesive materials, overlapped, easy open joints in containers of the invention can be provided having various degrees of adhesion upon drying Thus, some temporary adhesive materials exert only a minimal amount of adhesion upon drying so that the container will be self-opening following peeling of the outer layer. On the other hand, other adhesive material can be employed in the invention and, when dry, will exert a greater adhesive effect. It is specifically contemplated and considered to be a feature of the invention that, the need for an outer label layer can be eliminated in accordance with the invention where such a stronger adhesive is employed. Thus, the boardstock body wall layer itself can bear printing and function as the container label, without the need for a separate, outer layer label. In such instances, it will be apparent that the temporary adhesive layer between the overlapping edges of the container must exert sufficient adhesive force upon drying to maintain closed, the body wall until opening of the container by the consumer. In such cases, a relatively strong frangible or fracturable adhesive layer is advantageously employed so that the consumer can open the container by pressing on the seam of the container, thereby initiating fracture of the temporary adhesive.

Another benefit of the invention is that vacuum packaging can be successfully employed without damage to the container body. In conventional butt jointed easy open containers, the butt joint itself is weak. The application of vacuum to the interior of the container results in a partial or full inward transverse collapse, of the container body wall. However, with containers prepared according to this invention, vacuum can be applied to the interior of the container during packaging without significant collapse of the body wall. This can allow for significant benefits and advantages in packaging of products under vacuum or pressure conditions.

Still another benefit of easy open containers according to the invention is that the wicking of liquids along the butt jointed, easy open seam can be minimized or eliminated. Such wicking or "syruping" can result in failure of conventional butt jointed containers after long-term storage. Liquid is known to separate from dough products and be absorbed by the ends of the container body wall. In conventional easy open containers, the moisture resulting from the liquid inside of the container is known to be channeled along the butt jointed easy open seam of the container. Because the container body walls are more porous at the butt jointed edges, the butt jointed, easy-open seam is believed to exert a wicking action causing a concentration of liquid along the helical butt joint. This, in turn, results in either or both of delamination of the outer container label or delamination of the Kraft/foil inner liner. In either case, a container having unacceptable appearance or product protection can result. In containers provided according to this invention, such channeling of liquid along the easy open seam is minimized or eliminated because there is no butt joint. Particularly when the body wall edges have been compression skived or coated prior to lap jointing, the body wall edges are actually more resistent to wicking than the remainder of the container body wall. As a result, liquid from the interior of the container will be evenly absorbed by the container body wall at the top and bottom of the container, and any liquid absorbed will remain primarily at the top and bottom of the container because it is not being wicked away by the easy open seam. Because the top and bottom closures provide structural reenforcement of the container at the respective top and bottom ends of the container, less damage results in the container body wall. In order to minimize such wicking by the top and bottom container ends, the container ends, themselves can simply be coated to seal the ends prior to application of the closure members.

The extent or amount of overlap between container body walls in the lap jointed containers provided according to the invention can be varied depending upon the desired function of the easy open container. Generally, significant benefits and advantages can be obtained with as little as about 0.1 inch (25 mm) longitudinal overlap of the edges of the container body wall. On the other hand, significant easy open functionality can be retained with longitudinal overlaps as great as 0.50 inches (60 mm). Where the container is intended to be used for vacuum packing, a degree of overlap substantially above the minimum overlap, for example, 0.25 inches (60 mm) is advantageously employed. On the other hand, where it is desired that the container be self-opening, the extent of overlap is preferably in the lower range, e.g. less than 0.370 inches (90 mm) is advantageously chosen. It will also be recognized that the amount of overlap chosen will be influenced in part by factors such as diameter of the container body and the strength of the temporary adhesive employed.

The following examples are provided in order to illustrate practice of the invention, but are not intended to be construed as limiting the invention.

EXAMPLE

Easy open containers were prepared in the container manufacturing process illustrated in FIG. 5, by laminating a layer of paperboard as the body wall in combination with an aluminum foil composite inner liner around a stationary cylindrical mandrel having a diameter of about 2 inches. The inner liner was heat sealed on the mandrel in an contiguous spiral bond, prior to winding of the boardstock layer onto the mandrel. The last layer was a pre-printed label layer. Both edges of the paperboard body stock were compression skived to provide a final board thickness of 60–70 percent of original thickness prior to winding on the mandrel. An adhesive consisting of low viscosity, high tack dextrin was applied to the top compressed edge of the boardstock. This was wound and matched to the other compressed, non-coated edge. Metal closure members were applied to both ends of the cans with the partial double lock construction illustrated in FIG. 8B.

The inner liners used in constructing the container were as follows:

L1: 25 lb Kraft/Tie layers/0.000285 inch Foil/Tie layer/6 lb High Density Polyethylene (HDPE)
L2: 17 lb. Kraft/Tie layer/0.000285 inch Foil/Tie layer/6 lb HDPE
L3: 0007 inch Foil/30 lb Wet Strength Kraft
L4: 0005 inch Foil/30 lb Wet Strength Kraft
L5: 00035 inch Foil/25 lb Wet Strength Kraft The boardstocks were as follows:

B1: 0.021 inch Wet Strength Kraft
B2: 0.018 inch Non-Wet Strength Kraft
B3: 0.018 inch Non-Wet Strength Kraft The Labels were as follows:

La1: 40 lb Wet Strength Kraft/0.003 inch Foil
La2: 60 lb Non-Wet Strength Kraft
La3: 40 lb Non-Wet Strength Kraft
La4: 25 lb Non-Wet Strength Kraft/0.003 inch Foil The containers had the following constructions:

| Container | Inner Liner | Boardstock | Label | Extent of Body Wall Overlap |
|---|---|---|---|---|
| A | L1 | B1 | La1 | 0.250 inch |
| B | L2 | B1 | La1 | 0.250 inch |
| C | L3 | B1 | La1 | 0.250 inch |
| D | L4 | B1 | La1 | 0.250 inch |
| E | L5 | B1 | La1 | 0.250 inch |
| F | L2 | B1 | La4 | 0.250 inch |
| G | L2 | B2 | La4 | 0.250 inch |
| H | L2 | B3 | La4 | 0.250 inch |
| I | L2 | B2 | La3 | 0.250 inch |
| J | L2 | B2 | La2 | 0.250 inch |
| K | L2 | B2 | La1 | 0.125 inch |
| L | L2 | B2 | La1 | 0.250 inch |

-continued

| Container | Inner Liner | Boardstock | Label | Extent of Body Wall Overlap |
|---|---|---|---|---|
| M | L2 | B2 | La1 | 0.500 inch |

The cans were tested for degree of seal by filling the cans with helium through a small hole in the metal closure, sealing and measuring leakage. The leakage note was sufficiently low that each construction was considered to be hermetically sealed. The cans were tested for operability by pressurizing the interior of each can and removing the label.

It was found cans having the thinner liners, the thinner paperboard walls and medium or low overlap tended to be self-opening while with the other cans, a touching or pressing on the seam was required for self opening of the cans. Thus cans having liners L2 and L5; boardstocks B2 and B3; and bodywall overlaps of 0.250 in. or less tended to be self opening. All cans were capable of withstanding interior vacuum without collapsing of walls.

The invention has been described in considerable detail with specific reference to its preferred embodiments. However, variations and modifications can be made within the spirit and scope of the invention as described in the foregoing specification and defined in the appended claims.

What is claimed is:

1. An easy-open container comprising a spirally-wound body wall having overlapped edges and an adhesive means between said overlapped edges for providing bonding of said overlapped edges during manufacture of said container but which dries to a layer of low adhesive strength, said body wall defining a substantially cylindrical container having opposed ends, the overlapped edges of the body wall defining an easy-open seam extending helically between the ends of the container;

a flexible barrier sheet liner bonded to the inner surface of the cylindrical body wall comprising an expandable fold extending helically between the ends of the container, the fold being positioned adjacent or overlapping the interior of the easy-open seam of the body wall, wherein the marginal areas adjacent both sides of the easy-open seam on the interior of the body wall are free of bonding to the liner to assist in opening of the overlapped edges of the body wall.

2. The easy open container of claim 1 additionally comprising a substantially discrete layer of frangible adhesive between the overlapped edges of the body wall for releasably adhering the overlapped edges together.

3. The easy open container of claim 2 wherein the spirally wound body wall comprises paperboard having a thickness ranging from about 0.15 inches to about 0.030 inches.

4. The easy open container of claim 3 additionally comprising an outer, spirally wound label releasably adhered to the spirally wound body wall.

5. The easy open container of claim 3 wherein the overlapped edges of the spirally wound paperboard body wall are compressed to a thickness less than about seventy-five percent of the main portion of the paperboard body wall.

6. The easy open container of claim 5 wherein the edges of the spirally wound body wall overlap in an amount of between about 0.1 and about 0.5 inches.

7. The easy open container of claim 3 wherein the overlapped edges of the spirally wound body wall comprise a coating adapted to increase the penetration resistance of the overlapped edges.

8. The easy open container of claim 3 wherein the frangible adhesive layer between the overlapped edges of the spirally wound body wall comprises an adhesive material having a high initial tack strength and which dries to a substantially crystalline adhesive layer.

9. The easy open container of claim 3 wherein the edges of the spirally wound body wall overlap in an amount of at least about 0.125 inches.

10. The easy open container of claim 9 wherein the edges of the spirally wound body wall overlap in an amount of less than about 0.375 inches.

11. An easy-open container comprising:

a helically wound paperboard bodywall, the paperboard bodywall comprising transversely compressed and longitudinally overlapping edges, the helically wound bodywall defining a substantially cylindrical container having opposed ends and the longitudinally overlapped edges of the bodywall defining an easy-open seam extending helically between the ends of the container; and a temporary adhesive means having a high tack when wet but which dries to a material having a low adhesive strength between the longitudinally overlapped, transversely compressed edges of the paperboard bodywall for releasably adhering the overlapped edges of the body wall together and to allow opening of the container along the easy open seam.

12. The easy-open container of claim 11 wherein the helically wound paperboard body wall has a thickness of between about 0.01 and about 0.03 inch.

13. The easy-open container of claim 12 wherein the transversely compressed and longitudinally overlapping edges of the helically wound paperboard body wall overlap in an amount of between about 0.1 and about 0.5 inch.

14. The easy-open container of claim 13 wherein the substantially discrete layer of frangible adhesive between the longitudinally overlapped, transversely edges of the paperboard body wall comprises an adhesive material having an initial tack strength of greater than about 0.1 lb/in.

15. The easy-open container of claim 14 additionally comprising a flexible barrier sheet liner bonded to the inner surface of the cylindrical body wall comprising an expandable fold extending helically between the ends of the container, the fold being positioned adjacent or overlapping the easy-open seam of the body wall, wherein the marginal areas adjacent both sides of the easy-open seam on the interior of the body wall are free of bonding to the liner to assist in opening of the releasably adhered overlapped edges of the body wall.

16. The easy-open container of claim 15 additionally comprising a spirally wound, outer label releasably adhered to the spirally wound body wall.

17. The easy-open container of claim 16 additionally comprising an end closure member attached to at least one end of the substantially cylindrical container the end closure member being attached by a partial double lock construction such that the end of the body wall of the container is flanged outwardly and partially extends into a rolled edge of the periphery of the closure member.

18. The easy-open container of claim 17 wherein the spirally wound outer label comprises a circumferential cut extending from one seam of the spirally wound label particularly around the circumference of the container body.

19. The easy-open container of claim 18 wherein the frangible adhesive material between the longitudinally overlapped, transversely compressed edges of the paperboard body wall comprises a dextrin based adhesive.

20. A method for manufacturing an easy-open container comprising the steps:

compressing a continuous edge portion on each side of a continuous bodywall paperboard sheet;

coating a temporary adhesive having a high tack when wet but which drys to a material having a low adhesive strength onto at least one face of at least one compressed continuous edge portion of the continuous edge portion of the continuous bodywall paperboard sheet;

spirally winding the continuous bodywall paperboard sheet onto a mandrel in edge overlapping relation so that the face of one compressed overlapping edge of the container bodywall paperboard sheet contacts the adhesive coated face of the other compressed overlapping edge, thereby forming a continuous releasably adhered bodywall tube;

cutting the continuous, releasably adhered bodywall tube into a plurality of cylindrical container body sections of predetermined length; and fixedly attaching a closure member to at least one end of the plurality of cylindrical container body sections of predetermined length.

21. The method of claim 20 additionally comprising the steps prior to cutting the continuous releasably adhered body wall tube of:

providing a continuous outer label sheet;

coating one face of the outer label sheet with a temporary adhesive; and spirally winding the adhesive coated continuous outer label sheet onto the continuous, releasably adhered, body wall tube.

22. The method of claim 20 additionally comprising the steps prior to the step of spirally winding the paperboard body wall sheet onto the mandrel of:

providing a continuous, inner liner, barrier sheet;

forming a continuous fold on one edge of the continuous, inner liner barrier sheet; and;

spirally winding the continuous inner liner barrier sheet onto the mandrel to thereby form a continuous, tubular inner liner on the mandrel prior to the winding of the continuous paperboard body wall sheet onto the mandrel.

23. The method of claim 22 wherein the paperboard body wall sheet which is wound onto the mandrel is positioned such that the overlapping edge portions thereof are contacting or longitudinally adjacent the continuous folded edge of the inner liner barrier sheet on the mandrel.

24. An easy-open container comprising:

a spirally wound body wall having overlapped edges and defining a substantially cylindrical container having opposed ends, the overlapped edges of the body wall defining an easy-open seam extending helically between the ends of the container; and adhesive means comprising a frangible or fracturable adhesive between the overlapped edges of the bodywall for releasably adhering the overlapped edges of the bodywall together and to allow opening of the container along the helical, easy-open seam, said overlapped edges having been treated with a coating to resist penetration of said adhesive into said bodywall.

25. The easy-open container of claim 24 wherein the overlapped edges of the body wall are each compressed to a thickness less than 80 percent of the main portion of the body wall.

26. The easy-open container of claim 24 additionally comprising a spirally wound, outer label releasably adhered to the spirally wound body wall.

27. The easy-open container of claim 24 additionally comprising a spirally wound inner liner bonded to the inner surface of the cylindrical body wall, the liner comprising a flexible sheet barrier material.

28. The easy-open container of claim 24 wherein the edges of the helically wound body wall overlap in an amount of between about 0.1 and about 0.5 inch.

29. The easy-open container of claim 24 wherein the adhesive layer between the overlapped edges of the spirally wound body wall comprises an adhesive material having a high initial tack strength and which dries to a substantially crystalline adhesive layer.

30. The easy-open container of claim 24 wherein the overlapping edges of the container body wall are beveled.

31. The easy-open container of claim 24 additionally comprising an end-closure member attached to at least one end of the substantially cylindrical container.

32. The easy-open container of claim 24 wherein the overlapped edges of the body wall are each compressed to a thickness less than 80 percent of the main portion of the body wall.

* * * * *

UNITED STATES PATENT AND TRADEMARK OFFICE

CERTIFICATE OF CORRECTION

PATENT NO. : 5,251.809

DATED : October 12, 1993

INVENTOR(S) : Drummond, et al.

It is certified that error appears in the above-indentified patent and that said Letters Patent is hereby corrected as shown below:

Col. 4, line 52, please delete "advantageous" and insert -- advantageously --.

Col. 6, line 40, please delete "30" and insert -- 20 --

Col. 7, line 4, after "up" and before "an", please insert -- of --.

Col. 8, line 39, please delete "as" and insert -- is --.

Col. 9, line 42, please delete "an".

Col. 11, line 64, please delete "(25 mm) and insert -- (2.5 mm) --.

Col. 11, line 68, please delete "(60 mm)" and insert -- (12.0 mm) --.

Col. 12, line 3, please delete ("60 mm)" and insert -- (6.0 mm) --.

Col. 12, line 6, please delete "(90 mm)" and insert -- (9.0 mm) --.

Col. 12, lines 41 please delete "L3: 0007" and insert -- L3: 0.007 --.

UNITED STATES PATENT AND TRADEMARK OFFICE

CERTIFICATE OF CORRECTION

PATENT NO. : 5,251,809

DATED : October 12, 1993

INVENTOR(S) : Drummond et al.

It is certified that error appears in the above-identified patent and that said Letters Patent is hereby corrected as shown below:

Col. 12, line 42, please delete "L4: 0005" and insert -- L4: 0.005 --.

Col. 12, line 43, please delete "L5: 00035" and insert -- L5: 0.0035 --.

In Claim 14, please delete "transversely" and insert -- compressed --.

Signed and Sealed this

Seventh Day of March, 1995

Bruce Lehman

*Attest:*

BRUCE LEHMAN

*Attesting Officer*

*Commissioner of Patents and Trademarks*